United States Patent [19]

Eaton, Jr.

[11] 4,123,743

[45] Oct. 31, 1978

[54] TERMINATION FOR AN ELECTRICAL RESISTANCE ELEMENT

[75] Inventor: John L. Eaton, Jr., Delanco, N.J.

[73] Assignee: SCM Corporation, New York, N.Y.

[21] Appl. No.: 715,483

[22] Filed: Aug. 18, 1976

[51] Int. Cl.[2] ..... H01C 1/14

[52] U.S. Cl. ..... 338/322; 219/541; 338/272

[58] Field of Search ..... 338/322, 323, 324, 326, 338/332, 334, 272–274, 276, 221, 233, 316, 318; 29/611, 619, 621; 219/552, 541, 544, 353, 548; 339/278 C

[56] References Cited

U.S. PATENT DOCUMENTS

| | | | |
|---|---|---|---|
| 1,483,625 | 2/1924 | Ruttenberg et al. | 338/272 X |
| 1,608,005 | 11/1926 | Schoeppler | 338/274 |
| 2,213,067 | 8/1940 | Ehlers | 338/274 |
| 2,269,195 | 1/1942 | Finlayson | 338/273 X |
| 2,553,875 | 5/1951 | Shaw | 338/274 X |
| 2,635,162 | 4/1953 | Kohring | 338/274 X |
| 2,927,299 | 3/1960 | Lefebvre | 338/318 X |
| 3,669,004 | 6/1972 | Eaton, Jr. et al. | 219/520 X |

*Primary Examiner*—C. L. Albritton

*Attorney, Agent, or Firm*—Armand G. Guibert; Milton M. Wolson

[57] ABSTRACT

A simple, low-cost U-shaped hook termination for enclosed resistance elements useful in household appliances. The termination is particularly useful with a releasable contact shaped to enter the enclosure end. The effects of out-of-squareness of the end can also be minimized.

11 Claims, 4 Drawing Figures

TERMINATION FOR AN ELECTRICAL RESISTANCE ELEMENT

BACKGROUND OF THE INVENTION

1. Field of the Invention

The invention disclosed relates generally to the structure of electrical terminals for resistance elements and more particularly to such structures in household appliances having glass-cased resistive heater elements in contact with spring-loaded connectors from a supply of electrical energy.

2. Description of the Prior Art

Enclosed elements for household heating or cooking appliances are well-known and have been used to protect users from electrical shock and to hold the heater wire in position. Danger of damage occasioned by transmitted shocks or mechanical forces is also minimized by the support and protection afforded by the enclosure. Where the enclosure is a medium relatively transparent to thermal radiation, e.g. glass, the transfer of heat by this mode is substantially unimpeded, but the limitations of glass as a structural material ordinarily require use of heater terminals having multi-part, complex structures with the electrical circuit consequently including a number of contact resistances which potentially cause undesired heat generation in the termination and resultant high temperatures in the contact area due to current flow. Such high temperatures shorten the useful life of parts in adjacent areas. Examples of known art are U.S. Pat. Nos. 2,790,885, 3,663,799 and 3,669,004. The first of these three patents shows a terminal having a cylindrical portion axially fitted into a glass bushing overlying a protective glass case for a ribbon heater element. By heating the bushing and compressing it around the cylindrical portion of the terminal and around an end of the heater ribbon led out to and riveted to the terminal, the bushing provides proper support and a seal for the terminal. The second patent of those cited shows a special extension with internal shoulders against which an insulating material is seated. The third patent, assigned to the same assignee as the current application, shows a spring-clip cap fitted over the tube end together with a contact rivet centrally located in the face of the cap and used for fastening one end of the heater element wire to the cap.

Typical multi-part terminations, while acceptable, are subject to the above-mentioned deficiencies leading to an initial cost higher than that of the structure herein disclosed and a shorter life because of higher contact temperatures caused by heat generation in the termination. Other examples showing similar complex structures and exhibiting substantially the same deficiencies are U.S. Pat. Nos. 1,667,857, 1,832,466, and RE 23679. For the reasons given above, there is needed a simpler termination applicable to elements having tubular transparent protective casings which will accommodate variations of diameter and length for seating purposes and also which exhibit lower cost, longer life, less heat generation in the terminal, and less heat flow to the energy-supply connection area.

SUMMARY OF THE INVENTION

The invention provides an improved termination for an electrical resistance element comprising an open-end insulating tubular case, the open end defining a peripheral edge and the case sheathing a resistance member having two ends, the improvement comprising combination thereof with at least one elongate, unitary termination having a first portion affixed to one of said two ends of the resistance member and a second portion in a shape adapted for direct engagement with the peripheral edge of said case. Further, the improved element may be used with the terminal in contact with a resiliently-biased connection system in which a projecting contact engages the interior of the case and the termination to provide both location of the tubular case and close electrical communication. Other features of the invention will be evident from the detailed explanation given below with reference to the appended drawing.

DESCRIPTION OF THE PREFERRED EMBODIMENTS

Figure 1:
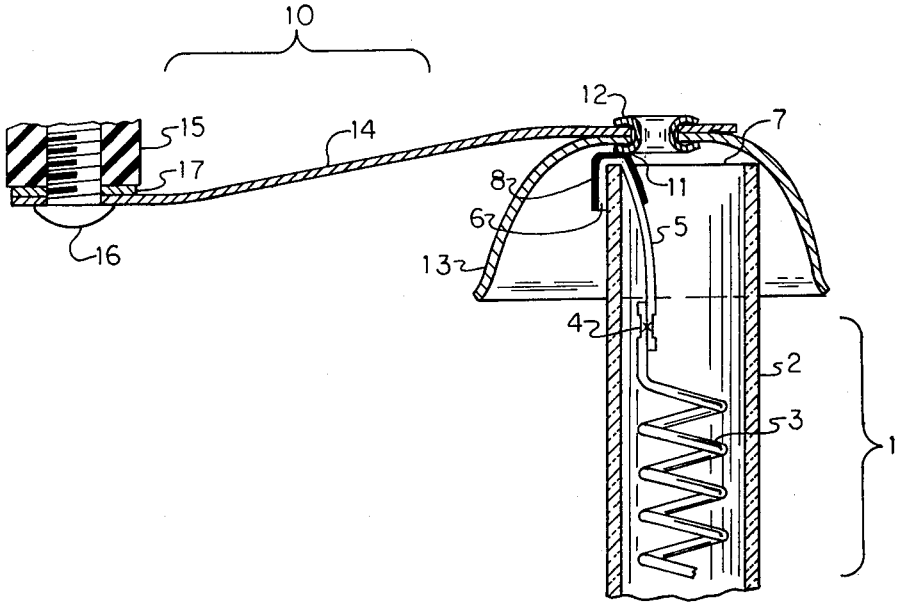
FIG. 1 is a cross-sectional view of a first embodiment of the terminal according to the invention, the terminal being shown in cooperative engagement with a spring-loaded cup-shaped connection member having an energizing contact at the base of the cup, the cup serving to locate the heating element.

In FIG. 1 is shown a first embodiment of the terminal according to the invention as applied to an electrical resistance unit in a household appliance, e.g. a heater element for a toaster or oven of the type disclosed in U.S. Pat. No. 3,669,004, for instance. The resistance unit is generally designated at 1 and comprises an insulating case 2, a resistance element 3 inserted therein, and—according to the invention—at one or both ends of elements 3, an elongated unitary terminal 5 described in greater detail subsequently. Case 2 may conveniently be a cylindrical tube preferably made of a high-temperature resistant glass such as Vycor, a trademark of Corning Glass Works. Resistance element 3 may utilize any known resistance wire such as a nickel-chromium alloy, but is preferably made of "Kanthal D" or "Alkrothal," trademarks of the Kanthal Corporation. Resistance element 3 may conveniently be wound into a helix and is solidly fastened at each end to a respective one of the terminals 5 as indicated at 4 in FIG. 1. The fastening may be achieved, for example, by overlapping an end of element 3 and an adjacent end of terminal 5, followed by spotwelding. Other known forms of fastening which lead to a good electrical junction could likewise be employed, of course.

The material of terminal 5 and its cross-sectional area are preferably selected with a view to obtaining an optimum balance between heat generation due to the electrical resistivity and heat flow to the contact region due to the thermal conductivity of the material. In this respect, applicant has found the preferable materials to be nickel and iron or alloys thereof. A particular nickel-iron alloy which has been found most suitable is one containing 70% nickel and 30% iron, known as "Balco" (TM) and supplied by Wilbur B. Driver Co. of Newark, New Jersey. The cross-sectional area must likewise be balanced between a large area for minimum heat generation and small area for minimum heat flow. Once the material has been chosen, the optimum area can be determined by actual tests.

Each terminal 5 (only one being shown in FIG. 1) is an elongated member conveniently made of a length of the above-mentioned alloy in strip-form with rectangular cross section and shaped into a tube-end engaging means 6 at its end remote from the spotwelded junction 4. Tube-end engaging means 6 may be made, for instance, by bending the strip into a U-shape hereinafter referred to as hook 6. As seen in FIG. 1, hook 6 engages the periphery of tube 2 at the tube end 7, and has a coating 8 of low electrical contact resistance which coating may, for example, be a noble metal such as silver or gold supplied by electroplating or puddling before or after forming hook 6. Though only needed on that surface of hook 6 which will contact a current-carrying element 10 providing a flexible connection to a supply of electrical energy (not shown), the protective coating 8 may be applied, if more convenient, around all sides and the ends of U-shaped hook 6.

Figure 2:
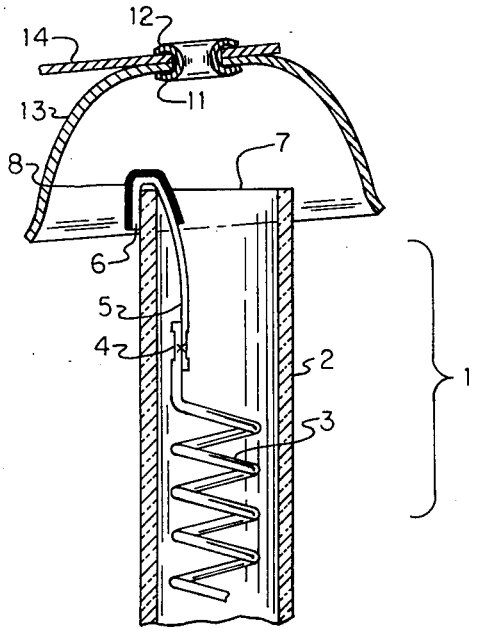
FIG. 2 is a cross-sectional view of the terminal of FIG. 1, the terminal here being shown in the process of being brought into (or removed from) cooperation with the cup-shaped connection member.
Figure 3:
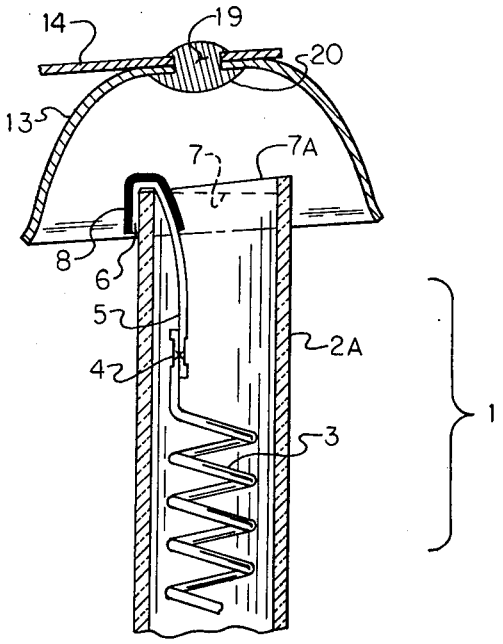
FIG. 3 shows yet another arrangement in which the terminal of FIG. 1 is shown in cooperation with a resiliently-biased contact having a projection engaging the interior of the heater element case.

Element 10 comprises a resilient support and an electrical contact. The resilient support is a buss member 14 and may be a cantilevered strip made by electrically-conductive spring metal, e.g. stainless steel or beryllium copper. The contact in element 10 is located near the free end of buss member 14 and may be an eyelet 12 as shown in FIGS. 1 & 2 or may alternatively be a solid rivet—as seen in FIG. 3. The eyelet 12 not only serves to make electrical union with hook 6 through a face 11 opposite plating 8, but also is the means by which a cup-shaped socket 13 is affixed to buss member 14, the socket 13 being designed to receive the end 7 of heater element 1. It will be evident that resilience in member 14 is required to provide contact-making pressure between eyelet 12 and coating 8 and to provide means for release of heater element 1 for replacement or other purposes, as shown in FIG. 2.

Buss member 14 is mounted on an insulating post 15 (or other similar frame member of an appliance) by means of a fastener 16 (which may be a screw or rivet, as is known). Fastener 16 clamps the fixed end of buss member 14 to a conductor 17 supported on post 15 and connected to a supply of electrical energy in known fashion.

The tube-end 7 has been depicted in FIGS. 1 and 2 as being planar and "square," that is—orthogonal to the tube axis (not shown). In the process of producing long runs of parts, wear in the cut-off tools for the tubes may cause raggedness (non-planarity) of the ends. Flame polishing to remove raggedness and sharp edges may leave slight beads or raised areas on the edges. Furthermore, imprecision in setting of the cut-off tools from batch to batch may cause significant variation in the squareness of the cut. These imperfections may be such as to effect the reliability of the above-described socket-type contact arrangement.

While the embodiment of FIGS. 1 & 2 shows use of eyelet 12 making electrical contact to terminal 5, this structure may be improved, as shown in FIG. 3, by using a domed contact 19 affixed to buss member 14. Contact 19 may conveniently be a solid rivet staked to buss member 14 near the free end of that member and having a contact face 20 which engages the interior of tube 2*a* at its end 7*a*. In contrast with the tube 2, the end 7 of which is "square," one or both of the ends 7*a* of tube 2*a* may be non-planar and non-orthogonal to the tube axis (not indicated). To illustrate this in FIG. 3, a planar, orthogonal end 7 similar to that for tube 2 of FIGS. 1 and 2 is indicated by the dotted lines for comparison with the solid line 7*a*. The non-planar end can be extensive enough to cause the tube end 7 to bear against eyelet 12 thus preventing terminal coating 8 from making electrical contact with eyelet 12. The domed contact is designed to minimize the effect of the above-described variations. The cross sectional shape of contact face 20 is shown as arcuate in FIG. 3, the dome of contact 19 thus being indicated to be spherical but it could be a frustum of a cone, or other desired body of revolution, providing that it tapers in the direction away from the region of abutment against buss member 14. The taper must be sufficient, of course, to permit the contact to extend into the interior of tube 2*a* at end 7*a*. Projection of a portion of the domed contact 19 into tube end 7 provides a locating function and assures that contact will be made between contact 19 and terminal 5. It will be clear, of course, that the rivet 19 should be made of or coated with material of low electrical contact resistance such as the silver previously disclosed or an equivalent thereof.

Figure 4:
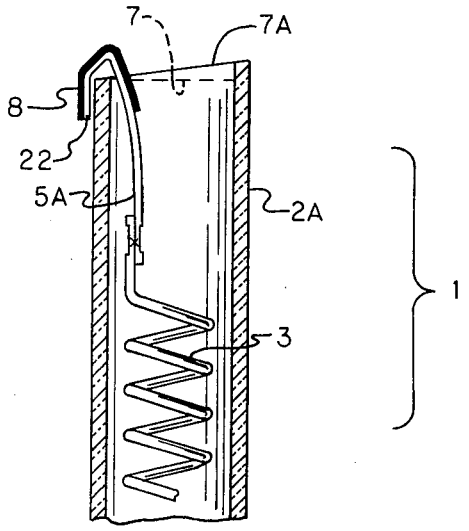
FIG. 4 shows yet another embodiment of the terminal wherein an angularly projecting portion is provided.

In order to retain the basic structure of the terminal of FIG. 1 and yet avoid the previously-mentioned problems possibly arising from non-planar and non-orthogonal ends 7*a*, another embodiment disclosing a slightly different shape for the elongated unitary terminal 5 is shown in FIG. 4, this shape being designed to overcome the limitations of the structure of FIG. 1 when variations in the planarity and "squareness" of the cut ends 7*a* of high-volume production lots of tubes 2*a* are of concern.

In FIG. 4, there is depicted an elongated unitary terminal 5*a* having a formed end 22 which differs from the embodiment of FIGS. 1 & 2 only in that the U-shape has a skewed base, the skew being provided to a degree sufficient to cause projection of a portion of the end 22 beyond the furthest reaches of the end 7*a*, such that contact between the silver plating 8 on end 22 of terminal 5*a* and the contact face 11 of eyelet 12 is assured regardless of variations in the planarity and "squareness" of ends 7*a* in a batch of tubes from any given production run.

As will now be evident to those skilled in the art, use of a unitary, elongated terminal dispenses with the multiplicity of parts such as members for supporting and centering a precious-metal contact, say, at each end of the heater assembly. Not only does such use produce a lower cost type of construction by eliminating unnecessary parts, but it results furthermore in less heat rise in the contact area because of the elimination of a possibly high electrical junction resistance near the eyelet contact 12 (or 19).

The foregoing description of a simplified termination for an electrical resistance element comprises a protective, electrically insulating tubular case 2, a resistance element 3, and an elongated unitary terminal 5, located at one end, at least, of element 3 and engaging the corresponding end 7 of case 2. The termination is particularly useful with a resilient connection 10 to an electrical supply, the connection having a projecting contact 19 on a resilient buss member 14, the electrical circuit being completed through cooperation between elongated unitary terminal 5 and contact 19 on the interior of a case 2*a* having non-planar, out-of-square ends 7*a*.

What is claimed is:

1. In an electrical resistance element comprising an open-end insulating tubular case having an axis, the open end defining a peripheral edge, and the case sheathing a helical resistance member having two ends, the combination thereof with at least one elongate, unitary termination having a first substantially axially-extending portion affixed to one of said two ends of the resistance member, and a second portion in a shape adapted to engage the peripheral edge of said case under control of said helical resistance member, only a minor fraction of the peripheral edge being engaged and said shape of the second portion alone preventing displacement of the termination in a direction perpendicular to said case.

2. In an electrical resistance element comprising an open-end insulating tubular case, the open end defining a peripheral edge, and the case sheathing a resistance member having two ends, the combination thereof with at least one elongate, unitary termination having a first portion affixed to one of said two ends of the resistance member and a second portion in a shape adapted to engage the peripheral edge of said case, said second portion bearing a layer of low contact resistance metal at least on a surface thereof external to said case.

3. The combination of claim 1, wherein said second portion is a U-shaped hook.

4. The combination of claim 3 wherein the case has a wall of predetermined thickness and the U-shaped hook has a base and two arms of unequal length extending therefrom, the base being of a length greater than said predetermined thickness such that the base is capable of straddling said wall, and the longer of said two arms being affixed to said one end of the resistance member.

5. The combination of claim 4, wherein said base has first and second opposed surfaces, said first surface being adjacent said case; and further including a layer of low contact resistance metal at least on said second surface of the base.

6. The combination of claim 3, wherein the tubular case has an axis and a midpoint, said peripheral edge has portions extended beyond a discrete plane orthogonal to said axis, said plane being defined by passing through the point of the peripheral edge located at the least distance from said midpoint of the case, and said U-shaped hook having a base capable of straddling said peripheral edge, said base being skewed with respect to the peripheral edge in a manner sufficient to project at least a part of said base further from said midpoint than said extended portions of the peripheral edge.

7. In an electrical appliance having opposed electrical circuit members for releasably connecting a heating element to a source of electrical energy, the combination of an open-end insulating tubular case having a wall and sheathing a resistance wire as said heating element, said resistance wire being terminated at each end thereof with an elongate, unitary termination is strip from having a first part affixed to a respective end of the wire and a second part adapted to engage said wall at said open-end, a contact borne on each said opposed member, said contact having a first section of a size adapted for ready insertion within said open-end and progressively enlarging distally thereof to a second section of a size greater than said open end, and resilient means for bringing said opposed members toward each other subsequent to insertion of said heating element therebetween, thereby providing entry of each said contact within a respective open end to a point where said second part of the unitary termination is in close electrical communication with said contact proximate said second section thereof.

8. The combination of claim 7, wherein said second part bears a layer of low contact resistance metal at least on a surface thereof external to said case.

9. The combination of claim 7, wherein said second part is a U-shaped hook.

10. The combination of claim 9, wherein said wall has a predetermined thickness and the U-shaped hook has a base and two arms of unequal length extending therefrom, the base being of a length greater than said predetermined thickness such that the base is capable of straddling said wall, and the longer of said two arms being affixed to said one end of the resistance wire.

11. The combination of claim 10, wherein said base has first and second opposed surfaces, said first surface being adjacent said case; and further including a layer of low contact resistance metal at least on said second surface of the base.

* * * * *

UNITED STATES PATENT OFFICE

CERTIFICATE OF CORRECTION

Patent No. 4123743 Dated October 31, 1978

Inventor(s) John L. Eaton, Jr.

It is certified that error appears in the above-identified patent and that said Letters Patent are hereby corrected as shown below:

Col. 3, line 57, "effect" should be--affect--,

Col. 6, line 12, "is" should be--in--, line 13, "from" should be--form--

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*